United States Patent [19]

Tanimoto et al.

[11] 4,287,584

[45] Sep. 1, 1981

[54] SPEECH-SYNTHESIZER TIMEPIECE

[75] Inventors: Akira Tanimoto, Kashihara; Mituhiro Saizi, Kyoto, both of Japan

[73] Assignee: Sharp Kabushiki Kaisha, Osaka, Japan

[21] Appl. No.: 18,174

[22] Filed: Mar. 7, 1979

[30] Foreign Application Priority Data

Mar. 25, 1978 [JP] Japan ..... 53-34681

[51] Int. Cl.[3] ..... G04B 21/08

[52] U.S. Cl. ..... 368/63

[58] Field of Search ..... 58/4 A, 12–15, 58/38 A, 38 R, 575, 58, 152 R, 152 B; 368/28, 63, 75, 251, 272

[56] References Cited

U.S. PATENT DOCUMENTS 3,998,045 12/1976 Lester ..... 58/14

3,999,050 12/1976 Pitroda ..... 58/152

*Primary Examiner*—Vit W. Miska

*Attorney, Agent, or Firm*—Birch, Stewart, Kolasch & Birch

[57] ABSTRACT

A speech-synthesizer timepiece disclosed herein is adapted to provide audible sounds indicative of time and/or calender information. The audible sounds are followed by an adjective phrase which represents such a unit of the preceding time and/or calender information as month, day, day of the week, hours, and minutes. The adjective phrase consists of one or more audible sounds like that indicative of the body of the time and/or calender information.

5 Claims, 13 Drawing Figures

SPEECH-SYNTHESIZER TIMEPIECE

BACKGROUND AND SUMMARY OF THE INVENTION

The present invention relates to a speech-synthesizer timepiece which provides audible sounds indicative of time and calendar information.

A speech-synthesizer timepiece is well known, for example, U.S. Pat. No. 3,998,045 TALKING SOLID STATE TIMEPIECE by R. W. Lester. A prior art timepiece was adapted to provide audible sounds indicative of time information in the form of a series of digits only. In other words, there was nothing in the audible sounds which modified the audible time information, for example, units of the preceding digital time information such as hours, minutes and seconds. It was, therefore, difficult to recognize the audible sounds indicative of time information accurately.

Accordingly, it is an object of the present invention to provide an improved speech-synthesizer timepiece which can provide audible sounds indicative of not only digit information but also unit information concerning updated time information.

It is another object of the present invention to provide an improved speech-synthesizer timepiece which can provide audible sounds indicative of not only digit information but also unit information concerning updated calender information.

BRIEF DESCRIPTION OF THE DRAWINGS

Other objects and many of the attendant advantages of the present invention will be readily appreciated as the same becomes better understood by reference to the following detailed description which should be considered in conjunction with the accompanying drawings, and wherein:

FIGS. 3 through 9 are flow charts showing control steps in the embodiment of the speech-synthesizer timepiece, wherein FIG. 3 shows a main routine MAIN, FIG. 4 shows a month announcing routine VOMNT, FIG. 5 shows a date announcing routine VOD, FIG. 6 shows a hour announcing routine VOH, FIG. 7 shows a minute announcing routine VOM, FIG. 8 shows a day of the week announcing routine VOW, and FIG. 9 shows a sound delivering routine VO;

DETAILED DESCRIPTION OF THE INVENTION

Figure 1:
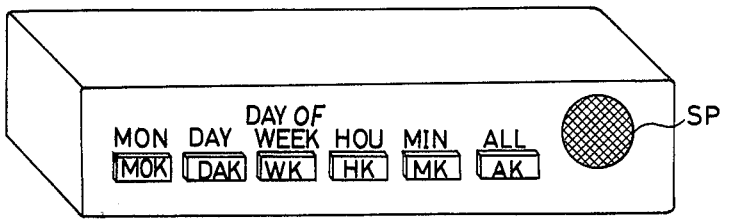
FIG. 1 is a perspective view of a speech-synthesizer timepiece in one preferred embodiment of the present invention.

Referring now to FIG. 1, there is illustrated in a perspective view one preferred form of the present invention, which includes recall keys such as "month", "day", etc., and a loud speaker SP, thereby providing audible sounds in accordance with actuations of the recall keys. For example, an audible sound "—gatsu (month in English)" is provided upon actuation of the "month" recall key, an audible sound "—nichi(day in English)" is provided upon actuation of the "day" recall key, and an audible sound of full calender and time length "—gatsu—nichi—yohbi (day of the week in English) —ji (hour in English)—fun or pun (minute in English)" is provided upon actuation of the "all" recall key.

Figure 2:
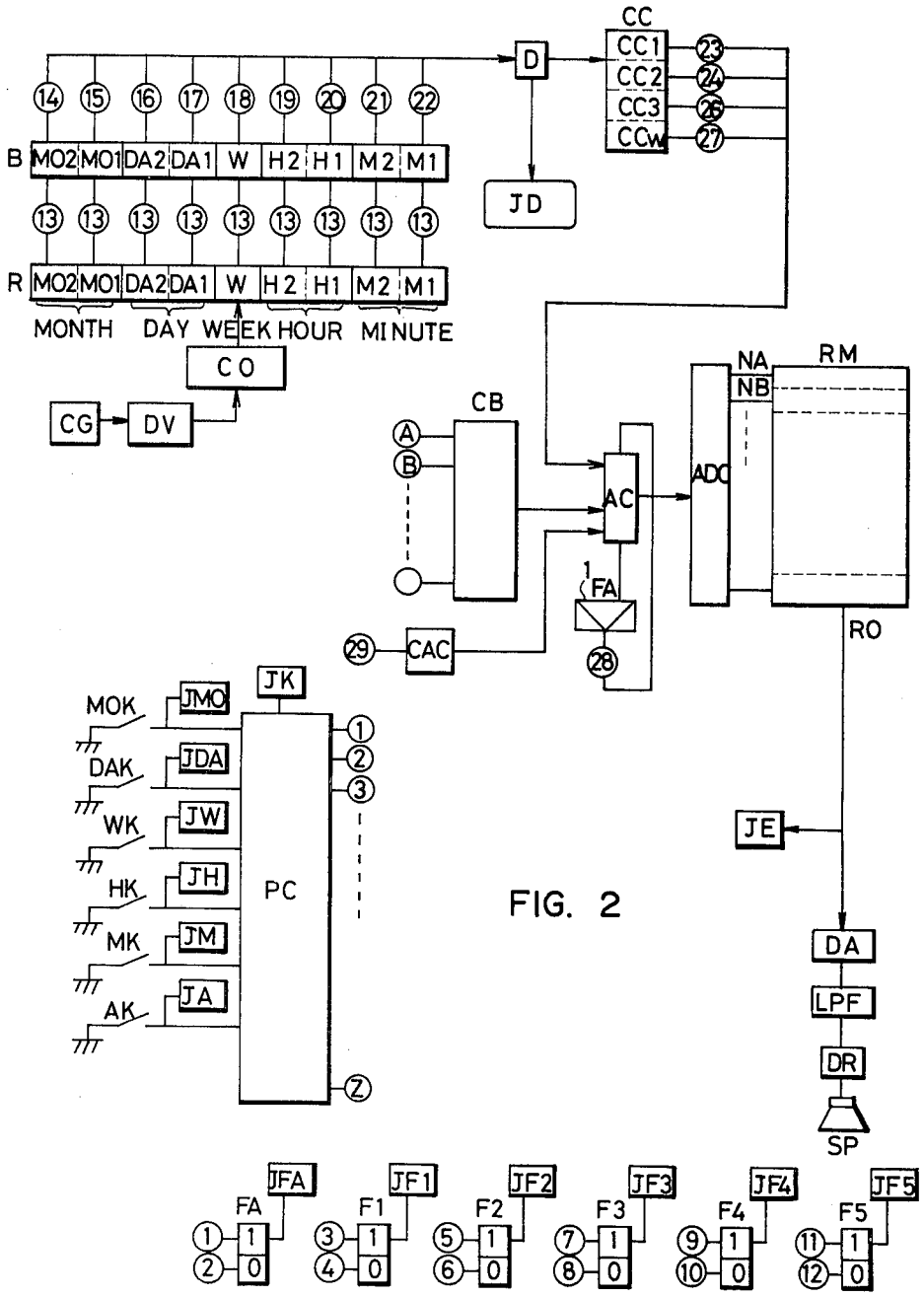
FIG. 2 is a circuit block diagram of the speech-synthesizer timepiece of FIG. 1.

In FIG. 2 showing a block diagram of the speech-synthesizer timepiece embodying the present invention, an oscillator CG generates a time standard signal and a divider DV divides the time standard signal into a 60 KHz signal. A counter series CO provides a "month" signal, a "day" signal, a "day of the week" signal, a "hour" signal, and a "minute" signal for introduction to the corresponding regions of a timekeeping register R. The contents of the timekeeping register R are transferred into a second register B in response to the development of a command (13). Upon the development of commands (14) - (22), information in respective regions of the register B is transferred into a buffer register D. The register B consists of nine regions: Two regions $MO_2$ and $MO_1$ storing "month" information in the order of tens of months and months, two regions $DA_2$ and $DA_1$ storing "day" information in the order of tens of days and days, a region W storing "day of the week" information, two regions $H_2$ and $H_1$ storing "hour" information in the order of tens of hours and hours, and two regions $M_2$ and $M_1$ storing "minute" information in the order of tens of minutes and minutes.

A read only memory RM stores sound quantizing digital codes per voice word element. Table 1 sets forth the relationship between the type and the voice initial address of the respective voice elements.

TABLE 1

| | | | | | |
|---|---|---|---|---|---|
| NA | ichi | NO | jyu | NAC | futsu |
| NB | itsu | NP | ji | NAD | mi |
| NC | ni | NQ | pun | NAE | itsu |
| ND | san | NR | fun | NAF | mui |
| NE | yo | NS | rei | NAG | nano |
| NF | yon | NT | gatsu | NAH | yoh |
| NG | go | NU | tsuitachi | NAI | kokono |
| NH | roku | NV | ka | NAJ | getsu |
| NI | rotsu | NW | toh | NAK | ka |
| NJ | nana | NX | hatsu | NAL | sui |
| NK | hachi | NY | nichi | NAM | moku |
| NL | ku | NZ | yohbi | NAN | kin |
| NM | kyu | NAA | shi | NAO | do |
| NN | jyuh | NAB | yo | NAP | nichi |

In the foregoing table 1, NA, NB, NC, . . . NAP denote the initial addresses of the respective word elements which are terminated with END codes led out during the final steps. The output $R_0$ of the read only memory RM is provided in the form of digital codes and then converted via a digital-to-analog converter DA and a low pass filter LPF into analog waveform signals suitable to the generation of audible sounds. The audible sounds are released from a loud speaker SP via a driver DR.

A first voice initial address circuit CC decides the voice initial address in accordance with the contents of the buffer register D in providing a desired audible sound. Address data is loaded into an address counter AC. A second voice initial address circuit CB decides a desired voice initial address pursuant to a command to be described later, the initial address thus decided being loaded into the same address counter AC. An adder FA effects additions of "1" to the contents of the address counter AC, incrementing the address specified by the second voice initial address circuit CB. A reset circuit CAC resets the address counter AC and, when the address counter AC is in the reset condition, none of the addresses in the read only memory RM may be designated. In this way, the address counter AC establishes the voice initial address and increments the address for selection of the respective word elements from the read only memory RM via an address decoder ADC.

A decision logic circuit JD is connected to the buffer register D to decide if the contents of the buffer register D are "0" or "1, 4" or "1, 3, 4, 6", whereas a decision logic circuit JE detects the END codes led out from the read only memory RM. RS type flip flops FA, F1–F5 provide various controls, with the set outputs thereof being sensed by decision logic circuits JFA and JF1–JF5. Key switches MOK–AK are actuated for announcing calender and time information in the form of audible sounds. The actuated and non-actuated conditions are sensed by decision logic circuits. A sequential control circuit PC is responsive to the conditions of the respective keys and the outputs of the various decision circuits JD, JE, JFA, JF1–JF5, JMO–JA and JK to develop commands 1, 2, ... Z. The month recall key is labeled MOK, the date recall key is labeled DAK, the day of the week recall key is labeled WK, the hour recall key is labeled HK, the minute recall key is labeled MK and the date/day of the week/time recall key is labeled AK.

Figure 3:
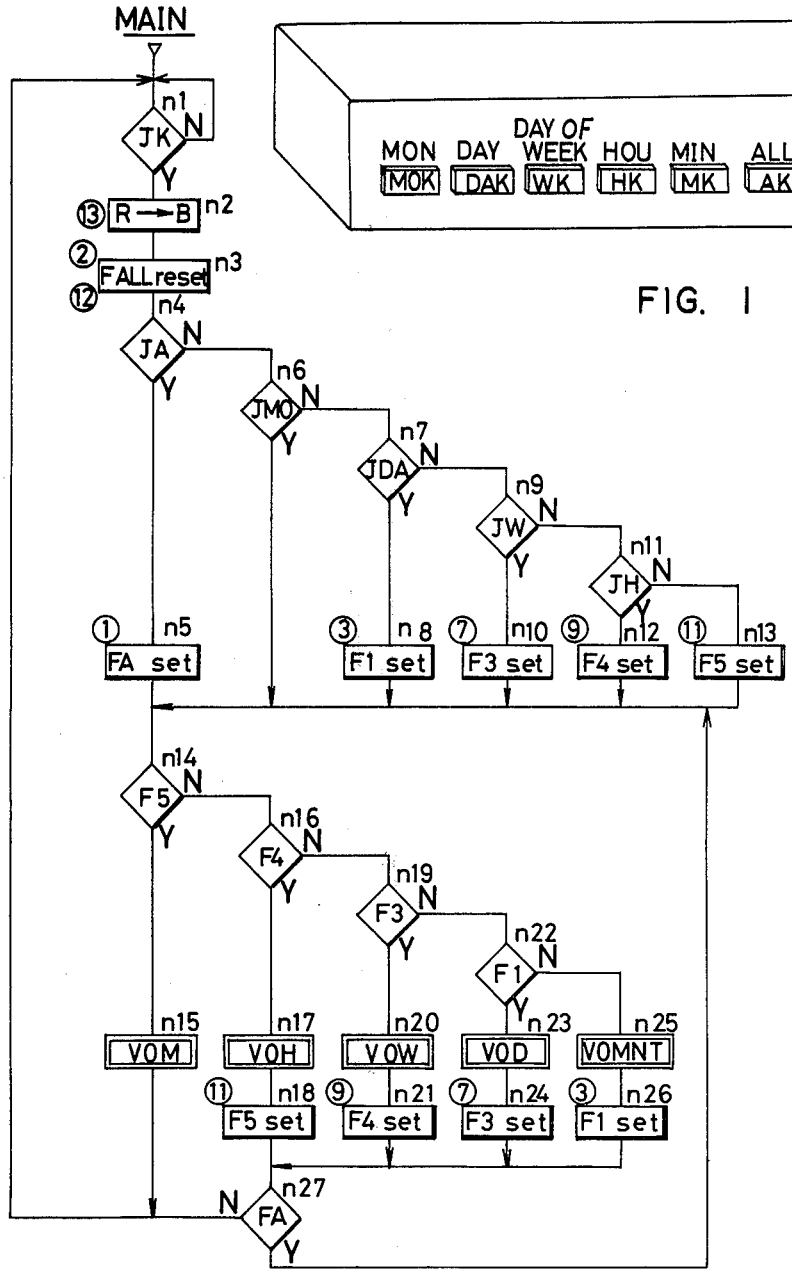

FIG. 3 shows a main routine of the sequential control circuit PC, whereby the operative conditions of the respective keys are monitored to select the announcing subroutines which are described in detail below.

Figure 4:
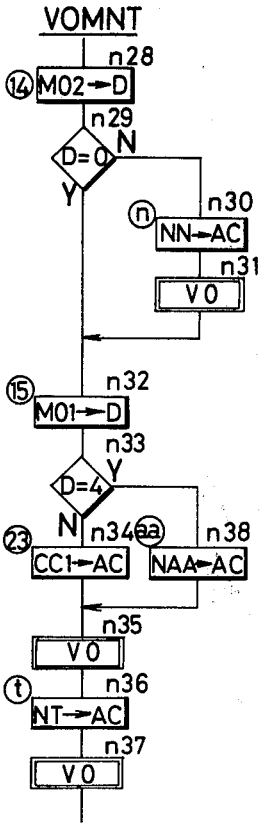
Figure 6:
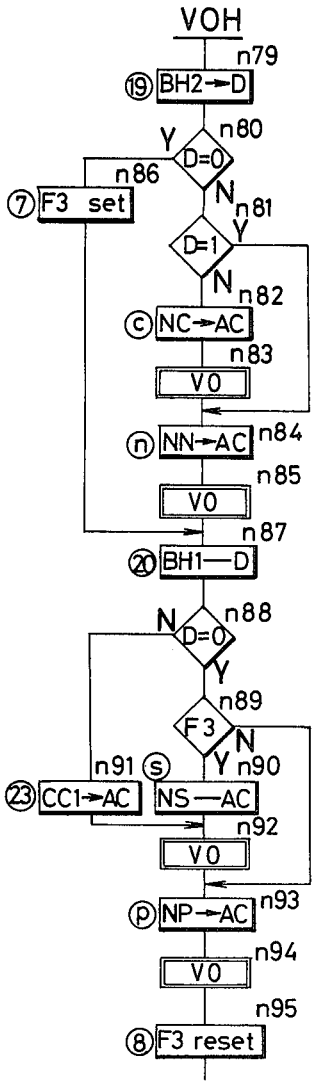
Figure 5:
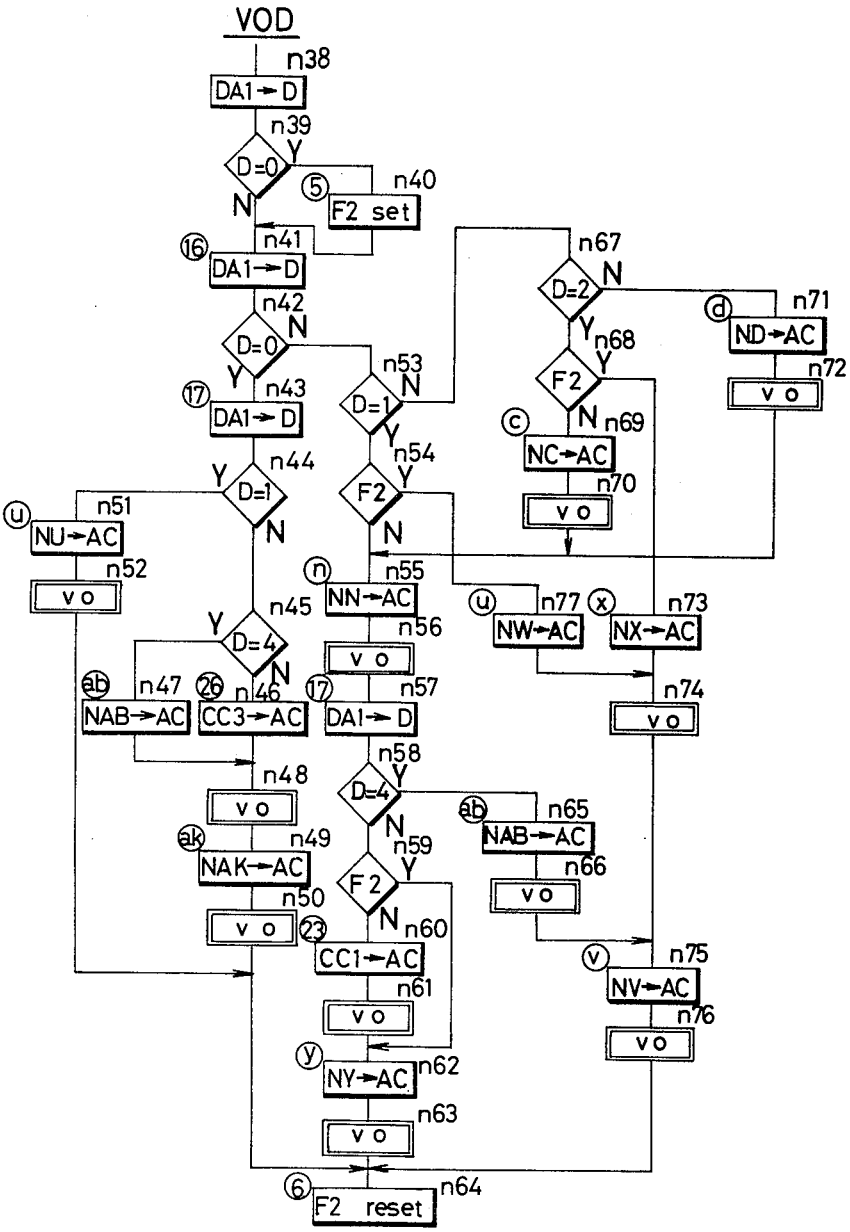
Figure 7:
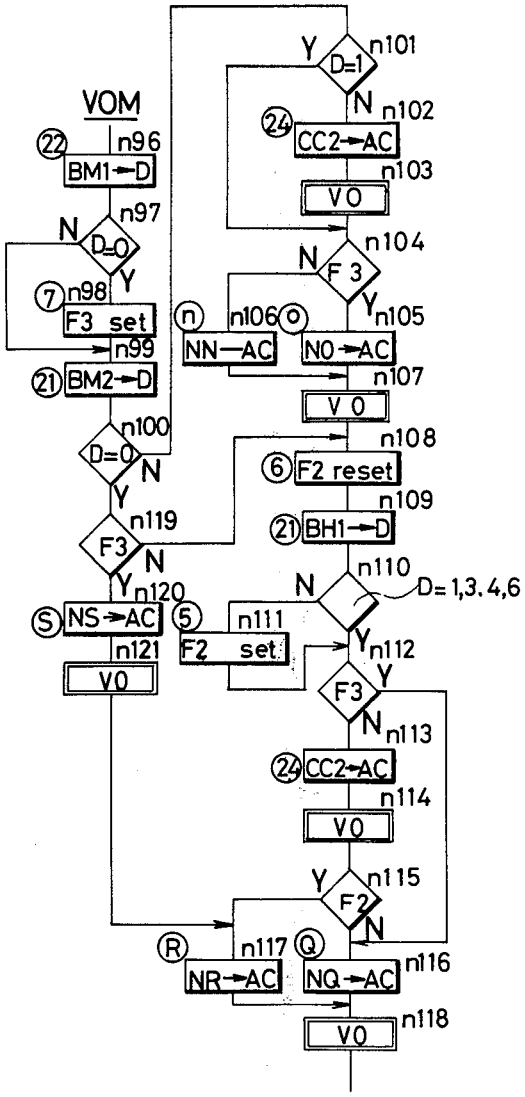
Figure 8:
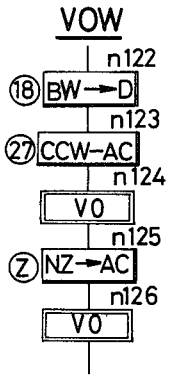

FIG. 4 shows the "month" announcing routine, FIG. 5 shows the "day" announcing routine, FIG. 6 shows the "hour" announcing routine, FIG. 7 shows the "minute" routine, and FIG. 8 shows the "day of the week" routine. These routines are described to give a better understanding of structure and operation of the device of FIG. 2.

[main routine MAIN: FIG. 3]

As stated briefly, the main routine is executed to monitor the operative conditions of the respective recall keys and select one of the announcing routines according to the results of such monitor.

During the step $n_1$ (abbreviated "$n_1$" hereinafter, likewise the step $n_2$ and so on) it is decided whether any of the recall keys has been actuated. If the affirmative answer is provided, $n_1 \rightarrow n_2$ so that a command (13) is developed to shift all the contents of the timekeeping register R into the register B, followed by $n_3$ whereby all the flip flops storing the various conditions are placed into the reset condition. The circuit configuration is, therefore, initiated prior to the beginning of the announcing modes.

The decision circuits JA, JMO, JDA, JW, JH monitor the operational conditions of the date/day of the week/time recall key AK, the month recall key MOK, the day recall key WK, the day of the week key WK, and the hour recall key HK, respectively, during $n_4$ to $n_{14}$, with the results of the monitoring operation being stored within the flip flops FA, $F_1$–$F_5$ in the set condition. Actuation of the minute recall key MK allows the procedure to to advance from $n_{11}$ to $n_{13}$, placing the flip flop $F_5$ into the set condition without monitoring the condition of the key MK. It is obvious from FIG. 3 that during $n_{14}$ the flip flop FA is set upon actuation of the AK key, all the flip flops are held in the reset condition upon actuation of the MOK key, the flip flop $F_1$ is set upon actuation of the DAK key, the flip flop $F_3$ is set upon actuation of the WK key, the flip flop $F_4$ is set upon actuation of the HK key, and the flip flops are monitored until $n_{22}$ for subsequent selection of the announcing subroutines.

The flip flop $F_5$ in the set condition permits $n_{14} \rightarrow n_{15}$ and renders the subroutine VOM operable. The flip flop $F_4$ in the set condition permits $n_{16} \rightarrow n_{17}$ and renders the subroutine VOH operable. The flip flop $F_3$ in the set condition enables the subroutine VOM via $n_{19} \rightarrow n_{20}$.

The flip flop $F_1$ in the set condition effects $n_{22} \rightarrow n_{23}$ leading to the subroutine VOD. In the event that any of the flip flops $F_5$, $F_4$, $F_3$ and $F_1$ is not in the set condition, $n_{22} \rightarrow n_{25}$ thereby starting the subroutine VOMT to provide desired audible sounds. If the flip flop FA is set, then the subroutine VOMT is enabled during $n_{25}$ and the flip flop $F_1$ is set upon $n_{25} \rightarrow n_{26}$ with the resulting sequences of $n_{26} \rightarrow n_{27} \rightarrow n_{14}$ and $n_{14} \rightarrow n_{16} \rightarrow n_{19} \rightarrow n_{22}$. Under the existing circumstance it is decided whether the flip flops are in the set condition and $n_{22} \rightarrow n_{23}$ results in selecting the subroutine VOD since the flip flop $F_1$ has been already set during $n_{22}$. Subsequent to this, $n_{20}$ is reached for providing an audible sound indicative of "day of the week" information. After completion of such announcing mode $n_{17}$ is effected for the hour announcing mode. Lastly, $n_1$ is restored after the minute announcing mode is completed during $n_{15}$. In conclusion, audible sounds are provided in the sequence of "month"→"date"→"day of the week"→"hour"→"minute" upon actuation of the AK key. The respective announcing modes are carried through in the following manner.

[subroutine VOMNT: FIG. 4]

The subroutine VOMNT is constructed for providing audible sounds indicative of "month" and stemmed from $n_{25}$ within the main routine.

During $n_{28}$ the command (14) is developed so that the "month" information in the order of tens of months is transferred from the region $MO_2$ of the register B to the buffer register D. The next succeeding $n_{29}$ is effected to decide if such information is "0". If D=O, $n_{32}$ is activated and, if D≠O, $n_{30}$ is activated. In the latter case D≠O any of jyugatsu (October) through Jyunigatsu (December) should be announced in audible sounds, implying that "jyu" should be first announced unconditionally. To this end $n_{30}$ and $n_{31}$ are effected to provide audible sound "jyu". In other words, the command (n) is developed during $n_{30}$ so that the second voice initial address circuit CB specifies the voice initial address NN concerning the word element "jyu" for the address counter AC. The voice announcing subroutine $V_0$ is next selected to provide audible sounds "jyu". Details of this routine will be described later.

After the production of the audible sounds "jyu" or after D=O is concluded during $n_{32}$, the command (15) is developed in $n_{32}$ such that "month" information in the order of months is transferred from the region $MO_1$ of the register B to the buffer D. $n_{33}$ is executed to sense if the contents of the buffer D are D="4" or D≠"4". In the former, $n_{38}$ is effected so that the voice initial address NAA concerning the word element "shi" is specified in the address counter AC by the second voice initial address circuit CB. Conversely, in the latter, the command (23) is developed so that the contents of circuit element $CC_1$ of the first voice initial address CC is loaded into the address counter AC with the voice initial address of the word element corresponding to the contents of the buffer D.

It will be noted from FIG. 2 that the first voice initial address decision circuit CC consists of four circuit elements $CC_1$, $CC_2$, $CC_3$ and $CC_w$ each deciding the voice initial address of the respective word elements. Table 2 lists such relationship between the word elements and the addresses.

TABLE 2

| | $CC_1$ | | $CC_2$ | | $CC_3$ | | $CC_4$ | |
|---|---|---|---|---|---|---|---|---|
| D | word element | address | word element | address | word element | address | word element | address |
| 1 | ichi | NA | i | NB | | | getsu | NAJ |
| 2 | ni | NC | ni | NC | fu | NAC | ka | NAK |
| 3 | san | ND | san | ND | mitsu | NAD | sui | NAL |
| 4 | yo | NE | yon | NF | | | moku | NAM |
| 5 | go | NG | go | NG | itsu | NAE | kin | NAN |
| 6 | roku | NH | ro | NI | mni | NAF | do | NAO |
| 7 | nana | NJ | nana | NJ | nana | NAG | nichi | NAP |
| 8 | hachi | NK | hachi | NK | yoh | NAH | | |
| 9 | ku | NL | kyu | NM | kokono | NAI | | |

Since the first voice initial address decision circuit $CC_1$ is selected during $n_{34}$, the voice initial address specified by the address counter AC is any of NA, NC, ND, NG, NH, NJ, NK and NL. If D="0", the address counter AC still remains in the previous condition or the reset condition. When the address counter AC specifies a particular address during $n_{34}$ or $n_{38}$, $n_{35}$ or the voice subroutine $V_0$ is reached to provide an appropriate word element. This is followed by $n_{36}$ where the command (t) is developed and the second voice initial address circuit CB specifies the voice initial address NT concerning the word element "gatsu" for the address counter AC. The audible sounds "gatsu" are provided through the subroutine VO in $n_{37}$. The relationship between the month information stored within the regions $MO_2$ and $MO_1$ of the register B and the audible sounds are viewed as follows:

| | | | |
|---|---|---|---|
| January | "ichigatsu" | July | "nanagatsu" |
| February | "nigatsu" | August | "hachigatsu" |
| March | "sangatsu" | September | "kugatsu" |
| April | "shigatsu" | October | "jyuhgatsu" |
| May | "gogatsu" | November | "jyuhichigatsu" |
| June | "rokugatsu" | December | "jyunigatsu" |

[subroutine VOD: FIG. 5]

The subroutine VOD starting with $n_{23}$ during the main routine is effected to provide audible sounds indicative of "day".

The command (17) is developed during $n_{38}$, shifting the "day" information in the order of days from the region $DA_1$ of the register B to the buffer D. Whether D="O" is determined during $n_{39}$, and when D="0" $n_{40}$ is executed to set the flip flop $F_2$. Subsequent execution of $n_{41}$ develops the command (16), transferring the "day" information in the order of tens of days from the region $DA_2$ of the register B to the buffer D. $n_{42}$ is effected to check if the contents of the buffer B are "0". If they are not "0", $n_{53}$ is effected to check again if they are "1". If not, $n_{67}$ is effected to check if they are "2". This is because the same digits should sometimes be pronounced in different sounds. In the case where D="0" during $n_{42}$, the following procedure will be carried out. In this case $n_{42} \rightarrow n_{43}$ where the contents of the region $DA_1$ of the register B are loaded into the buffer D. When D="1" during $n_{44}$, the command (u) is developed via $n_{51}$ and $n_{52}$ to specify the voice initial address $N_u$ concerning "tsuitachi" for the address counter AC. The sounds "tsuitachi" are provided during $n_{52}$. If D≠"1" during $n_{44}$, the next step $n_{45}$ is effected to check if the contents of the buffer D are "4". If D="4", the command (ab) is developed to specify the voice initial address NAB concerning the word element "yo" for the introduction to the address counter AC during $n_{47}$ in order to provide the word element "yo". Such word element "yo" is provided during $n_{48}$. Thereafter, the voice initial address NAK concerning the word element "ka" is specified by the address counter AC, followed by the audible sound "Ka" provided during $n_{30}$.

If D≠4 during $n_{45}$, $n_{46}$ is performed to specify the voice initial address concerning the word element corresponding to the contents of the buffer D through the address circuit $CC_3$ and load the same into the address counter AC. The word element is pronounced during $n_{48}$, $n_{49} \rightarrow n_{50}$. The "day" information stored within the register region DA1 and the audible sounds released from $n_{44}$ to $n_{50}$ are correlated as follows:

| | | | |
|---|---|---|---|
| 1st day | "tsuitachi" | 6th day | "muika" |
| 2nd day | "futsuka" | 7th day | "nanoka" |
| 3rd day | "mikka" | 8th day | "yohka" |
| 4th day | "yokka" | 9th day | "kokonoka" |
| 5th day | "itsuka" | | |

When D≠0 during $n_{42}$, $n_{42} \rightarrow n_{53}$ to decide if D=1. Since the "day" information should be pronounced starting with the tens of days unit in any case, there is established a distinction between ten's days, twenty's days and thirty's days. In order to provide peculier sounds, there should be further established between ten's and twenty's. In other words, $n_{53}$ is effected to make a distinction between ten's and twenty's and thirty's and $n_{67}$ between twenty's and thirty's.

During $n_{54}$ "tenth day" is distincted from other ten's days and during $n_{68}$ "twentieth day" is sensed different from other twenty's days. $n_{39}$ and $n_{40}$ are carried out to check if the flip flop $F_2$ is in the set condition. In the case of $n_{53} \rightarrow n_{54} \rightarrow n_{77}$, the contents of the regions $DA_2$ and $DA_1$ of the register B designate "tenth day" and during $n_{77}$ the command (W) is developed to load the voice initial address NW concerning the word element "toh" into the address counter AC through the action of the second voice initial address circuit CB. This is followed by $n_{74}$ where the voice subroutine VO is selected to provide an audible sound "toh". The development of the command (V) during $n_{75}$ permits the voice initial address NV concerning the word element "ka" to be loaded into the address counter AC, thereby providing an audible sound "ka". Therefore, audible sounds "tohka" are provided in succession.

Upon the advance of $n_{53} \rightarrow n_{67} \rightarrow n_{68} \rightarrow n_{73}$, the contents of the regions $DA_2$ and $DA_1$ of the register B specify "twentieth day" and the command (X) is developed during $n_{73}$, loading the voice initial address NX for the word element "hatsu" into the address counter AC through the second voice initial address circuit CB. The subroutine VO is selected during $n_{74}$ to provide the word element "hatsu" and provide the word element "ka" during $n_{75}$. In this case, "hatsuka" is pronounced in succession. "Tenth day" and "twentieth day" require the peculier pronunciations as above. Audible sounds indicative of tenth's days, twenth's days and thirty's days excluding the above described "tenth day" and "twentieth day" are provided in the following manner.

The first concern is the audible sounds indicative of tenth's days. Since in this case $D=1$ during $n_{53}$, $n_{54}$ is made operable where the flip flop $F_2$ remains in the reset condition. Then, during $n_{55}$ the command (n) is developed to load the voice initial address NN concerning the word element "jyuh" into the address counter AC. The voice subroutine VO is selected to provide an audible sound "jyuh" during $n_{56}$. The contents of the region $DA_1$ of the register B containing the "day" information in the order of days are transferred into the buffer D in response to the command (17). The contents of the register D are indicated in the form of audible sounds in the following manner. If $D=4$ provision of audible sounds "yokka" requires sequential execution of $n_{58} \rightarrow n_{65}$. In other words, the command (ab) is developed during $n_{65}$ to load the voice initial address NAB for the word element "yo" into the address counter AC through the second voice initial address circuit CB. Thereafter, the subroutine VO is selected to provide the word element "yo". The audible sound "ka" is provided through $n_{75}$ and $n_{76}$. If $D \neq 4$ during $n_{58}$, the procedure is effected in the sequence of $n_{59} \rightarrow n_{60}$ to develop the command (23) and load into the address counter AC the voice initial address for the particular word element corresponding to the contents of the buffer D through the first voice initial address circuit $CC_1$. $n_{60} \rightarrow n_{61}$ are sequentially executed to provide audible sounds corresponding to desired word elements. In the case of tenth's days, $n_{59}$ is not followed directly by $n_{62}$. This is because $n_{54} \rightarrow n_{77}$ when the flip flop $F_2$ is in the set condition.

Immediately after the "day" information is announced in the form of audible sounds during $n_{61}$, the unit information "nichi(day in English)" is to be provided. During $n_{62}$ the voice initial address NY concerning the word element "nichi" is established in the address counter AC and during $n_{63}$ the voice subroutine VO is selected and executed to provide audible sounds "nichi".

Audible sounds indicative of twenty's days are provided during the sequence of $n_{53} \rightarrow n_{67} \rightarrow n_{68}$. Audible sounds "hatsuka" are provided during $n_{68} \rightarrow n_{73}$. Since twenty's days other than twentieth day are all provided in audible sounds "nijyu . . . ", it is necessary to provide first audible sounds "nijyuh" when $n_{68} \rightarrow n_{69}$. This is accomplished in the sequence of $n_{69} \rightarrow n_{70} \rightarrow n_{55} \rightarrow n_{56}$. More fully discussed, the command (C) is developed during $n_{69}$ to load the voice initial address NC concerning the word element "ni" into the address counter AC through the second voice initial address circuit CB. The voice subroutine VO is selected to produce an audible sound "ni" during $n_{70}$, followed by $n_{55}$ wherein the command (N) during $n_{55}$ loads the address counter AC with the voice initial address NN concerning the word element "jyuh", enabling $n_{66}$ to make that audible sounds. Accordingly, the audible sounds "nijyuh" are provided during the sequence of $n_{69} \rightarrow n_{70} \rightarrow n_{55} \rightarrow n_{56}$. Upon the termination of the audible sounds indicative of the "day" information in the order to tens of days, $n_{57}$ is reached so that the audible sounds of the "day" information in the order of days are provided in the same way as above. In this case the flip flop $F_2$ is not likewise in the set condition during $n_{59}$. As long as the flip flop $F_2$ is in the set condition, the day to be announced at this moment is "twentieth day", permitting $n_{68} \rightarrow n_{73}$.

Audible sounds indicative of thirty's days are provided in the following way. Since $D=3$ during $n_{41}$, the events occur in the sequence of $n_{42} \rightarrow n_{53} \rightarrow n_{67} \rightarrow n_{71}$. The command (d) is developed during $n_{71}$, setting the address counter AC with the voice initial address ND concerning the word element "san", which in turn is announced during $n_{72}$. The audible sounds "jyuh" are provided in the same way as in the tenth's days and twenty's days via $n_{55} \rightarrow n_{56}$ . . . , followed by generation of audible sounds indicative of the "day" information in the order of days. In the case of thirty's days, it is possible that $n_{59}$ may be followed directly by $n_{62}$. This is due to the fact that the flip flop $F_2$ is in the set condition during $n_{40}$. In this case audible sounds "sanjyuhnichi" are provided until $n_{63}$ is reached. Since there is no possibility that $D=4$ during $n_{58}$, $n_{58}$ is necessarily followed by $n_{59}$. The following sets forth the relationship between the contents of $DA_2$ and $DA_1$ of the register B indicative of the "day" information and the corresponding audible sounds from $n_{53}$ to $n_{63}$.

| | | | |
|---|---|---|---|
| 10th day | "tohka" | | |
| 11th day | "jyuhichinichi" | 21st day | "nijyuhichinichi" |
| 12th day | "jyuhninichi" | 22nd day | "nijyuhninichi" |
| 13th day | "jyuhsannichi" | 23rd day | "nijyuhsannichi" |
| 14th day | "jyuhyokka" | 24th day | "nijyuhyokka" |
| 15th day | "jyuhgonichi" | 25th day | "nijyuhgonichi" |
| 16th day | "jyuhrokunichi" | 26th day | "nijyuhrokunichi" |
| 17th day | "jyuhnananichi" | 27th day | "nijuuhnananichi" |
| 18th day | "jyuhhachinichi" | 28th day | "nijyuhhachinichi" |
| 19th day | "jyuhkunichi" | 29th day | "nijyuhkunichi" |
| 20th day | "hatsuka" | 30th day | |
| | | ... | |
| | | "sunjyuh-nichi" | |
| | | 31st day | "sanjyuhichinichi" |

[Subroutine VOH: FIG. 6]

The subroutine VOH starting with $n_{17}$ of the main routine MAIN is executed to provide audible sounds indicative of "hour" information.

The flip flop $F_3$ is reset during $n_{81}$ and the command (19) is developed to transfer the "hour" information in the order to tens of hours from the region $H_2$ of the register B to the buffer D during $n_{79}$. Then, $n_{80}$ is effected to enable the decision circuit JD to check if the contents thus transferred are "0". If $D=0$, $n_{86}$ is enabled to set the flip flop $F_3$. Contrarily, if $D \neq 0$, $n_{80} \rightarrow n_{81}$ is effected to determine $D=1$ or $D \neq 1$, selecting either $n_{84}$ or $n_{82}$. In the former the voice initial address NN concerning the word element "jyuh" is loaded into the address counter AC through the second voice initial address circuit CB. Then, the voice routine VO is selected to provide audible sounds "jyuh" during $n_{85}$.

If $D \neq 1$, $n_{81} \rightarrow n_{82}$ with the development of the command (C) which permits the voice initial address NC concerning the word element "ni" to be loaded via the second voice initial address circuit CB into the address counter AC. During $n_{83}$ the voice subroutine VO is performed to provide the sound "ni", followed by provision of the audible sounds "jyuh" in $n_{84} \rightarrow n_{85}$. In conclusion, the audible sounds "nijyuh" are released during the sequence of $n_{81} \rightarrow n_{82} \rightarrow n_{83} \rightarrow n_{84} \rightarrow n_{85}$.

The above described procedure completes the provision of the audible sounds derived from the region $H_1$. The succeeding routines are effected successively to provide audible sounds indicative of the contents of the region $H_1$ and the hour information. When $D=0$ during $n_{80}$, $n_{87}$ is reached directly via $n_{86}$ so that an audible sound is not provided when the contents of the region $H_2$ are "0". It is necessary to provide audible sounds "reiji" only when the contents of the region $H_2$ are "0" and that of the region $H_1$ are "0". The reason why the flip flop $F_3$ is set during $n_{86}$ is because there is a requirement for determining the condition of the flip flop $F_3$ during $n_{89}$.

Upon arrival at $n_{87}$, since audible sounds indicative of the hour information in the order of hours are to be derived from the region $H_1$, the contents of the region H of the register B are transferred into the buffer D in response to the command (20). $N_{88}$ is carried out to check if the contents are "0" and when $D=0$ it is determined if the flip flop $F_3$ is in the set condition. If it is set, $n_{89} \rightarrow n_{90}$ is effected to provide audible sounds "rei" so that the command (S) is developed to specify the voice initial address NS concerning the word element "rei" for the address counter AC through the second voice initial address circuit CB. Then, the voice subroutine VO is selected to provide the audible sounds "rei" during $n_{92}$. Contrarily, if the flip flop $F_3$ is in the reset condition during $n_{89}$, there is no necessity for providing the audible sounds "rei" even when $D=0$ during $n_{88}$ because $D \neq 0$ during $n_{80}$. The next step is for the provision of an audible sound "ji" indicative of the unit of hours.

When $D \neq 0$ during $n_{88}$ and thus when the contents of the region $H_1$ storing the hour information in the order of hours are "0", the command (23) is developed during $n_{91}$, loading the address counter AC with the voice initial address of the word element as determined by the contents of the buffer D via the first voice initial address circuit $CC_1$ of CC in response to the command (23). During the next succeeding step $n_{92}$ the voice subroutine VO is selected for the purposes of providing desired word elements.

The contents of the regions $H_2$ and $H_1$ are indicated in audible sounds until $n_{92}$ and the hour unit information "ji" is provided in audible sounds, thereby terminating the subtoutine VOH. The command (p) is developed during $n_{93}$ to thereby establish the voice initial address NP concerning the word elements "ji" within the address counter AC through the second voice initial circuit CB. The voice subroutine VO is enabled to provide the audible sound "ji" during $n_{94}$.

From $n_{78}$ to $n_{95}$ the hour information stored within the regions $H_2$ and $H_1$ of the register B and the corresponding audible sounds are correlated as follows:

| | | | |
|---|---|---|---|
| 0 hour | "reiji" | 10 hour | "jyuhji" |
| 1 hour | "ichiji" | 11 hour | "jyuhichiji" |
| 2 hour | "niji" | 12 hour | "jyuhniji" |
| 3 hour | "sanji" | . | |
| | | . | |
| 4 hour | "yoji" | 15 hour | "jyuhgoji" |
| 5 hour | "goji" | . | |
| | | . | |
| | | . | |
| 6 hour | "rokuji" | . | |
| | | . | |
| 7 hour | "nanaji" | 20 hour | "nijyuji" |
| | | . | |
| 8 hour | "hachiji" | . | |
| | | . | |
| 9 hour | "kuji" | 24 hour | "nijyuhyoji" |

[Subroutine VOM: FIG. 7]

The subroutine VOM diverged from $N_{15}$ in the main routine MAIN is executed to provide audible sounds indicative of the "minute" information. In the case that the AK key is depressed, this is the final subroutine subsequent to the execution of the above detailed subroutines VOMNT, VOD, VOW, and VOH.

During $n_{96}$ the command (22) is developed to shift the minute information in the order of minutes from the register B to the buffer D. Thereafter, if $D=0$ during $n_{97}$, the flip flop $F_3$ is placed into the set condition at the transition of $n_{97} \rightarrow n_{98}$. To the contrary, if $D \neq 0$ the step in operation is skipped from $n_{97}$ to $n_{99}$ without executing $n_{98}$. The flip flop $F_3$ stores previously these conditions since subsequent pronunciations are different between $D=0$ and $D \neq 0$. $n_{99}$ is effected to shift the minute information in the order of tens of minute from the region $M_2$ of the register B to the buffer D. If $D=0$, $n_{100} \rightarrow n_{119}$ to decide if the flip flop $F_3$ is in the set condition. Otherwise, $n_{100} \rightarrow n_{101}$ to check if the contents of the buffer D are $D=1$ or $D>1$. Since $D \neq 0$ means that the contents of the register B are time information longer than 10 minutes, the voice routine is carried through for the "minute" information in the order of tens of minutes since $n_{101}$. If $D=0$, the contents of the register B are "0" or shorter than 10 minutes so that the flip flop $F_3$ is sensed with respect to the operational condition, leading to the voice routine for 0 minutes or less than 10 minutes. Since whether the flip flop $F_3$ is in the set condition has already decided during $n_{97}$ and $n_{108}$, the voice enabling subroutine for zero minutes is effected through $n_{119} \rightarrow n_{120}$, whereas the voice subroutine for the less than 10 minutes is effected through $n_{119} \rightarrow n_{108}$.

If $D \neq 0$ during $n_{100}$, $n_{101}$ is reached to decide whether $D=1$ or $D>1$. Assume now that $D \neq 1$ or $D>1$. $n_{101} \rightarrow n_{102}$ so that the voice initial address with respect to the word element corresponding to the contents of the buffer D more than "1" is established in the address counter AC via the first voice initial address circuit $CC_2$ upon the development of the command (24). Thereafter, the voice subroutine VO is enabled to provide an audible sound representative of a desired word element during $n_{103}$. $n_{104}$ is effected to sense the results with respect to the set condition of the flip flop $F_3$ determined during $n_{97}$ and $n_{98}$. $n_{105}$ is advanced in the case of the reset condition. The command (0) is developed during $n_{105}$, loading the address counter AC via the second initial address circuit CB with the voice initial address for the word element "jyu". On the other hand, the command n is developed during $n_{196}$ so that the voice initial address for the word element "jyuh" is placed into the address counter AC via the second voice initial address circuit CB. This is due to the fact that "jyu" should be pronounced when the minute information in the order of minutes is "0" and "jyuh" be pronounced when it is not "0". Provided that the address counter AC is loaded with the voice initial address for a desired word element, the voice subroutine VO is selected during $n_{197}$ to provide audible sounds "jyu" or "jyuh".

In the case where D=1 during $n_{101}$ or in the case where the contents of the region $M_2$ of the register B are "1", audible sounds "jyu" or "jyuh" may be provided and which of the audible sounds is determined according to the condition of the flip flop $F_3$ through $n_{101} \rightarrow n_{104}$.

After completion of the audible sounds indicative of the contents of the region $M_2$ in the order of tens of minutes from $n_{101}$ to $n_{107}$, the audible sound delivering subroutine is selected for the region $M_1$ storing the "minute" information in the order of minutes for the period starting with $n_{108}$. The command (6) is developed during $n_{108}$, placing the flip flop $F_2$ into the reset condition. The command (21) is next developed during $n_{109}$ to shift the contents of the region $M_1$ of the register B indicative of the "minute" information in the order of minutes into the buffer D. During $n_{110}$ it is decided whether D=1, 3, 4, 6 or D≠1, 3, 4, 6. $n_{110} \rightarrow n_{112}$ for the former and $n_{110} \rightarrow n_{111}$ for the latter. This is because of the necessity that there be a distinction between audible sounds "fun" and "pun" according to the contents of the "minute" information in the order of minutes, as best seen from Table 3.

TABLE 3

| | | | |
|---|---|---|---|
| 1 minute | ippun | 6 minutes | roppun |
| 2 minute | nifun | 7 minutes | nanafun |
| 3 minute | sanpun | 8 minutes | hachifun |
| 4 minute | yonpun | 9 minutes | kyufun |
| 5 minute | gofun | 0 minutes | reifun |

As is obvious from Table 3, the audible sounds "pun" are to be provided when D=1, 3, 4, 6 (the decision circuit JD=1, 3, 4, 6). If D≠1, 3, 4, 6, the flip flop $F_2$ is set via $n_{110} \rightarrow n_{111}$ and whether the flip flop $F_3$ is set is sensed via $n_{112}$.

As already discussed with respect to $n_{97}$ and $n_{98}$, the flip flop $F_3$ in the set condition means that the contents of the region $M_1$ in the order of minutes are "0". In this case $n_{116}$ is effected and then followed by the subroutine VOM for an audible indication of the minute information with the audible sound "pun". The command (Q) is developed during $n_{116}$ to introduce the voice initial address NQ regarding the word element "pun" into the address counter AC through the use of the second voice initial address circuit CB. Subsequently, the sounding subroutine VO is selected to release the sounds "pun" for $n_{118}$. Unless the flip flop $F_3$ has been set during $n_{112}$, the following step $n_{113}$ is carried out where the command (24) is developed to introduce into the address counter AC the voice initial address with respect to the word element corresponding to the contents of the buffer D via the first voice initial address circuit $CC_2$. The sounding subroutine VO is selected during $n_{114}$ for provision of an audible indication. Since $n_{115}$ the flip flop $F_2$ is checked with respect to the operational condition to make a distinction between the audible sounds "pun" and "fun". If the flip flop $F_2$ is in the set condition, $n_{115} \rightarrow n_{117} \rightarrow n_{118}$ are sequentially executed to provide "fun". When in the reset condition, $n_{115} \rightarrow n_{116} \rightarrow n_{118}$ with the audible sounds "pun". In summary, in the case where D≠1, 3, 4, 6 during $n_{110}$ the flip flop $F_2$ is set to provide "fun" since $n_{115}$. If D=1, 3, 4, 6, the audible sound "pun" is provided.

Futhermore, when the flip flop $F_3$ is reset during $n_{119}$, the register B assumes "0" with the results in the audible sounds "reifun" through $n_{120} \rightarrow n_{121} \rightarrow n_{171} \rightarrow n_{118}$. The command (S) is developed during $n_{120}$, locating the voice initial address NS with respect to the word element "rei" into the address counter AC through the second initial address circuit CB. For $n_{121}$ the voice subroutine VO is selected to provide "rei", followed by "fun" during $n_{117}$ and $n_{118}$.

The following is a listing of the audible sounds derived during the subroutine VOM.

| | |
|---|---|
| ten minutes | jyuppun |
| eleven minutes | jyuhippun |
| . | |
| . | |
| . | |
| . | |
| . | |
| fifteen minutes | jyuhgofun |
| sixteen minutes | jyuhroppun |
| . | |
| . | |
| . | |
| . | |
| . | |
| twenty minutes | nijyuppun |
| . | |
| . | |
| . | |
| fifty minutes | goiyuppun |
| . | |
| . | |
| . | |
| fifty nine minutes | gojyuhkyuhfun |

[Subroutine VOW: FIG. 8]

This subroutine VOW is constructed to provide audible sounds indicative of "day of the week", starting with $n_{20}$ in the main routine MAIN.

As long as "day of the week" is determined an audible sound is determinative without any second condition. This routine does not require any decision step for sensing the condition of the flip flop. What day of the week is audibly announced during $n_{122}$–$n_{124}$, followed by an audible sound "bi" during the sequence of $n_{125}$–$n_{126}$.

During $n_{122}$ the command (18) is developed, indicating the contents of the region W of the register B storing the day of the week information to be shifted into the buffer D. Subsequent to this, the command (27) is developed during $n_{123}$ so that the voice initial address with respect to the word element corresponding to the contents of the register D is introduced into the address counter AC via the first voice initial address circuit CCW. $n_{124}$ is then effected to enable the voice subroutine VO for providing the word element indicative of "day of week". During $n_{125}$ the command (Z) is provided, loading the voice initial address concerning word element "bi" into the address counter the AC with the aid of the voice initial address circuit CB. An audible indication of "bi" ($n_{126}$) follows. The relationship between the first voice initial address circuit $CC_W$ and the buffer D is suggested in Table 2.

Through these procedures the day of the week information is audibly indicated in the following relationship.

| | |
|---|---|
| Monday | "getsuyohbi" |
| Tuesday | "kayohbi" |
| Wednesday | "suiyohbi" |
| Thursday | "mokuyohbi" |
| Friday | "kinyohbi" |
| Saturday | "doyohbi" |
| Sunday | "nichiyohbi" |

Figure 9:
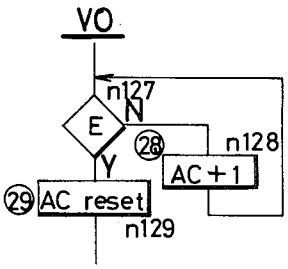

[Subroutin VO: FIG. 9]

The subroutine VO is one that is executed at the lowest level. The voice initial address concerning a desired word element within the address counter AC is increasingly incremented to derive sound quantizing data in succession from the output $R_o$ of the read only memory RM. This subroutine permits all the audible sounds to be released outside.

Figure 10:
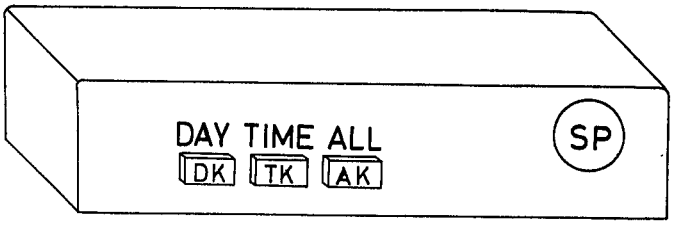
FIG. 10 is a perspective view of another preferred embodiment of the speech-synthesizer.
Figure 11:
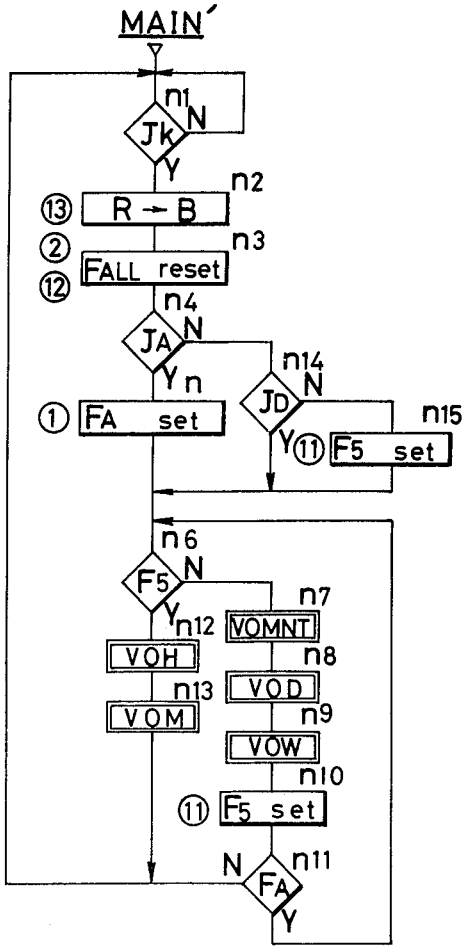
FIG. 11 is a time chart showing control steps in a main routine MAIN' in the second embodiment.

$n_{127}$ is effected to decide if the quantizing data at the voice initial address in the address counter AC is the END code. Otherwise, the address counter AC is incremented by one via $n_{128}$. $n_{128}$ is reached when the END code are to be sensed subsequent to return to $n_{127}$. While passing a closed loop of $n_{127} \rightarrow n_{128} \rightarrow n_{127} \rightarrow \ldots$, the address counter AC is incremented increasingly for eventual detection of the END code at $n_{127}$. The quantizing data keeps being derived in succession from the output $R_o$ until the development of the END code at $n_{127}$. The END code sensed permits the address counter AC through $n_{127} \rightarrow n_{129}$. In FIG. 10, there is illustrated another embodiment of the present invention with the number of keys reduced and manipulation simplified. FIG. 11 shows a modified main routine MAIN'. Circuit construction is similar to that in FIG. 2 except that a family of the recall keys consists of a date recall key in terms of month, day and day of the week, a time key in terms of hours and minutes, and the ALL key and the decision circuit consists of only three circuits ID, JT and JA.

The modified main routine MAIN' decides during $n_1$ whether any of the keys has been actuated. Upon detection of any actuated key the contents of the timekeeping register R are transferred to the register B during $n_2$ as in FIG. 3 and all the flip flops are reset during $n_3$. Subsequently, $n_4$ and $n_{14}$ are effected to decide which of the date key (DK), the time key (TK) and the ALL key (AK) has been actuated. $n_6$ will follow upon the date key DK actuated and $n_{15}$ and $n_6$ will follow upon the time key TK actuated wherein the flip flop $F_5$ is set. When the ALL key AK has been actuated, the flip flop FA is set during $n_5$, followed by $n_6$. These flip flops make distinction between the date announcing mode and the time announcing mode and selects the modes both or either. Whether the flip flop $F_5$ is set is decided during $n_6$. If the flip flop $F_5$ is set, $n_{12} \rightarrow n_{13}$ to execute the subroutines VOH and VOM for the time announcing mode. Otherwise, the subroutine VOMNT, VOD, and VOW are sequentially executed $n_7 \rightarrow n_8 \rightarrow n_9$ for the date announcing mode. In the case where the flip flip FA is set, $n_6 \rightarrow n_7 \rightarrow n_8 \rightarrow n_9$ are sequentially effected for the date announcing mode and the flip flop $F_5$ is set during $n_{10}$. Whether the flip flop $F_A$ is in the set condition is determined during $n_{11}$, followed by $n_6$. Since the flip flop $F_5$ is in the set condition during $n_{10}$, $n_6 \rightarrow n_{12} \rightarrow n_{13}$ are effected for the time announcing mode. Those subroutines are identical to that as shown in FIGS. 4 and 5.

Figure 12:
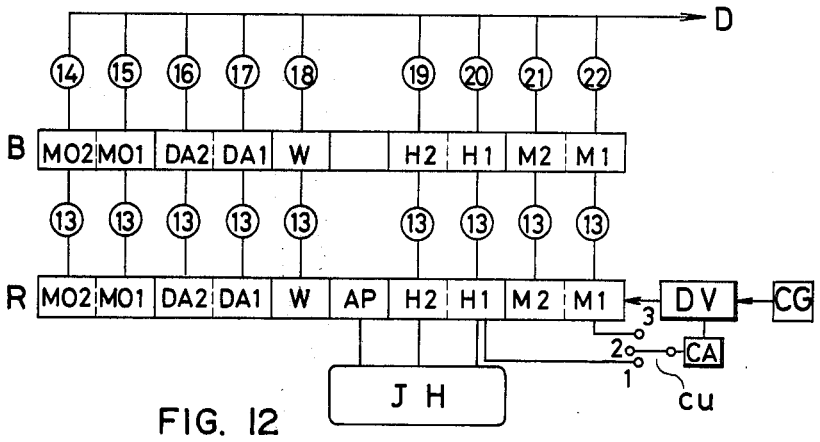
FIG. 12 is a block diagram of the timepiece having time correction facilities.

In FIG. 12, the timkeeping register (FIG. 2) is additionally provided with a region AP storing AM and PM information, which is connected to a time correction circuit Cu and a decision logic circuit JH determining whether the contents of the storage regions AP, $H_2$, and $H_1$ are "0". When it is desired to correct time and when the contents of the regions are "0", i.e. when it is twelve o'clock midnight, only the date information is audibly provided. A buffer CA is provided for keeping output pulses from the divider DV at a fixed interval.

Figure 13:
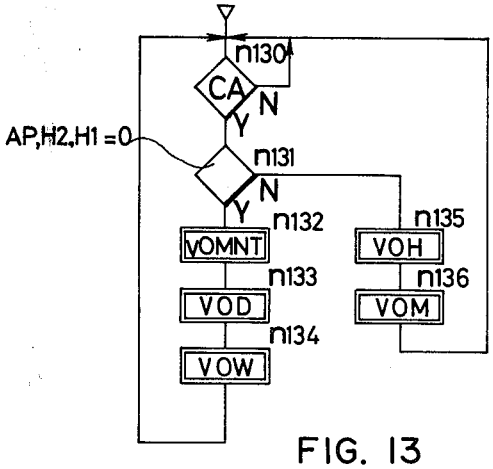
FIG. 13 shows control steps in the timepiece of FIG. 12.

Referring to FIG. 13, $n_{130}$ is effected to decide whether CA is in the set condition. If one pulse comes from the divider DA, CA is set. After CA is set, the decision circuit JH during $n_{131}$ decides whether the contents of the regions AP, $H_2$ and $H_1$ assume a specific condition, namely, "0" (the contents "0" of AP imply AM and the contents other than "0" imply PM). When they are "0", $n_{131} \rightarrow n_{132}$ are sequentially effected and when they are not "0", $n_{135} \rightarrow n_{136}$ are effected.

$n_{13} \rightarrow n_{132}$ are effected at 12 o'clock midnight and when the date is to change, followed by $n_{132} \rightarrow n_{133} \rightarrow n_{134}$ for the month/day/day of the week announcing modes. Otherwise, $n_{131} \rightarrow n_{135}$ are effected. Each time the divider DV provides a pulse $n_{135} \rightarrow n_{136}$ are effected to provide audible sounds indicative of time. When AP, $H_2$ and $H_1$ reach "0" with incrementing the counting operation, the date information is audibly indicated through the sequence of $n_{131} \rightarrow n_{132} \rightarrow N_{133}$. This sequence is repeated as long as the time correction circuit Cu is connected across terminals 1 and 3. The terminal 1 is connected to the region $H_1$ storing the time information, the terminal 2 is connected to an OFF terminal of the time correction circuit Cu, and a terminal 3 is connected to the region $M_1$ storing the minute information. The counting operation is incremented from the $H_1$ region to the more significant region by connecting the terminal 1 to the divider DV and from the $M_1$ region to the upper significant region by connecting the terminal 3 to the divider DV.

As stated above, calender information or time information is selected and audibly indicated at any desired point in time so that date or time is recognizable readily without being disturbed by the surrounding brightness. Sound converting means and other circuit constructions may be implemented with LSI technology without replying upon magnetic recording, thereby reducing a space requirement to a minimum.

The invention being thus described, it will be obvious that the same may be varied in many ways. Such modifications are not to be regarded as the departure from the spirit and scope of the invention, and all such modifications are intended to be included within the scope of the following claims.

What is claimed is:

1. A speech synthesizer timepiece capable of producing audible sounds indicative of updated time and updated calender information, comprising, means for producing said updated time and updated calendar information and for developing time information output signals and calender information output signals indicative, respectively, of said updated time information and said updated calender information;

input means for selecting desired time information or desired calender information for audible sound producing purposes;

memory means for storing a plurality of sound-related codes therein;

a first voice initial address circuit means responsive to said time information output signals and said calender information output signals and to the selection made via said input means for developing a first set of voice initial addresses representative of the location in said memory means storing the sound-related codes indicative of at least a portion of the desired time or calender information selected via said input means;

a second voice initial address circuit means responsive to the selection made via said input means for developing a second set of voice initial addresses representative of the location in said memory means storing the sound related codes indicative of an adjective phrase describing the body of the desired time or calendar information;

locating means responsive to said first and second set of voice initial addresses from said voice initial address circuit means for locating selected ones of said sound-related codes in said memory means, said memory means generating first and second output signals in a predetermined order in response thereto, said first output signals from said memory means representing said desired time or calendar information, each of said second output signals from said memory means being developed subsequent to the development of a corresponding one of said first output signals and representing said adjective phrase describing the body of said desired time or calendar information represented by said corresponding one of said first output signals; and audible sound generation means responsive to said first and second output signals from said memory means for developing audible sounds in accordance with said first output signals from said memory means and for developing audible sounds in accordance with said second output signals from said memory means, each said audible sounds corresponding to said second output signls being developed subsequent to a corresponding one of the audible sounds developed from said first output signals.

2. The speech synthesizer timepiece of claim 1 wherein:

said desired time information represented by said first output signals comprises hour and minute information;

said desired calender information represented by said first output signals comprises month information, day information, and day-of-the-week information;

said adjective phrases represented by said second output signals describing the body of said hour and minute information comprises hour and minute, respectively;

said adjective phrases represented by said second output signals describing the body of said month information, said day information, and said day-of-the-week information comprises month, day, and day-of-the-week, respectively; and said memory means generates said first output signals representing said hour information and said minute information, or said month information, said day information, and said day-of-the-week information prior to the generation of said second output signals representing said adjective phrases.

3. The speech synthesizer timepiece of claim 2 wherein said input means comprises a plurality of keys, said plurality of keys including a month selecting key, a day selecting key, a day-of-the-week selecting key, an hour selecting key, a minute selecting key, and an ALL key, said ALL key utilized for selecting both said desired time information and ssid desired calendar information to produce audible sounds indicative of the selected month, the selected day, the selected day-of-the-week, the selected hour, and the selected minute.

4. The speech synthesizer timepiece of claim 1 wherein said locating means comprises an address counter means for locating said selected ones of said sound-related codes in said memory means in response to said first and second set of voice initial addresses from said voice initial address circuit means;

wherein said speech synthesizer timepiece further comprises means for resetting said address counter means for preventing the location of said selected ones of said sound-related codes in said memory means by said address counter means.

* * * * *